United States Patent [19]

Kaul, Jr.

[11] 4,227,341

[45] Oct. 14, 1980

[54] RING TOY

[76] Inventor: William A. Kaul, Jr., 10009B Spearfish Ave., Ellsworth AFB, S. Dak. 57706

[21] Appl. No.: 966,617

[22] Filed: Dec. 5, 1978

[51] Int. Cl.[3] ..... A63H 33/02

[52] U.S. Cl. ..... 46/220; 273/337

[58] Field of Search ..... 46/220, 114, 221; 273/100, 104, 106 C, 126 R, 128 A, 129 F, 54 R; 48/164, 431, 173

[56] References Cited

U.S. PATENT DOCUMENTS

| | | | |
|---|---|---|---|
| 1,243,334 | 10/1917 | Murray | 46/220 |
| 1,557,788 | 10/1925 | Atkin | 273/100 |
| 2,573,915 | 11/1951 | Lewis | 248/164 |
| 2,649,140 | 8/1953 | Housel | 248/431 |
| 2,981,543 | 4/1961 | Peterson | 273/100 |
| 3,049,833 | 8/1962 | Felsch | 46/220 |
| 3,123,937 | 3/1964 | Pace | 46/220 |
| 3,539,183 | 11/1970 | Lieb | 273/54 R |
| 4,070,792 | 1/1978 | Voyovich | 46/220 |

*Primary Examiner*—Robert Peshock
*Assistant Examiner*—Mickey Yu
*Attorney, Agent, or Firm*—Merchant, Gould, Smith, Edell, Welter & Schmidt

[57] ABSTRACT

A ring toy including a generally T-shaped first member having a wheel rotatably mounted thereon, so that the toy can be advanced over the ground to impel a rolling ring, and a generally T-shaped second member pivotally connected to the first member for pivotal movement of the second member with respect to the first member so that the toy is self-standing. The toy also includes a ring launching device and a ring holder to store a ring or a plurality of rings.

6 Claims, 19 Drawing Figures

FIG. 7
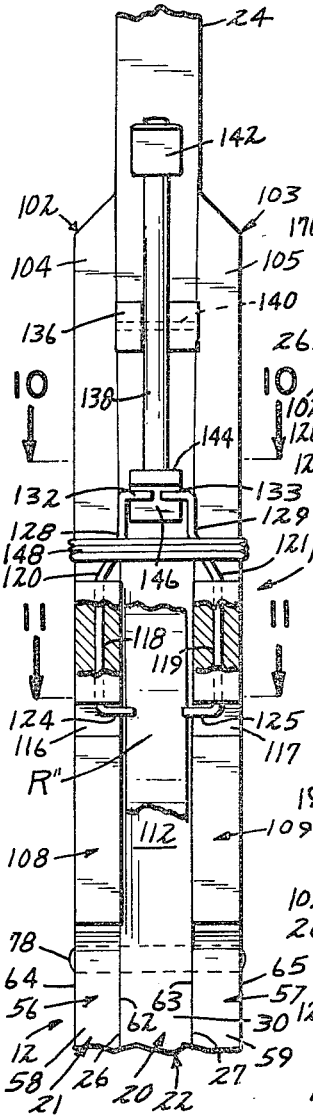
FIG. 10
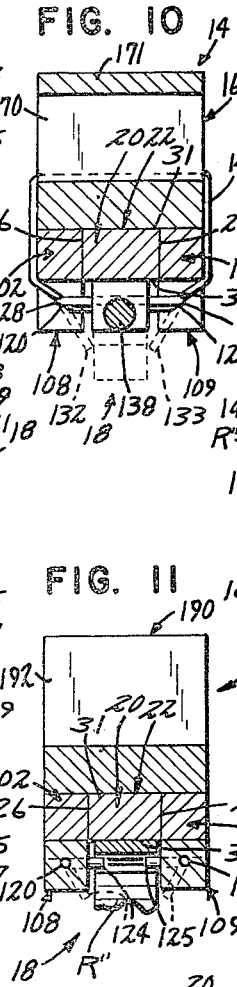
FIG. 11
FIG. 8
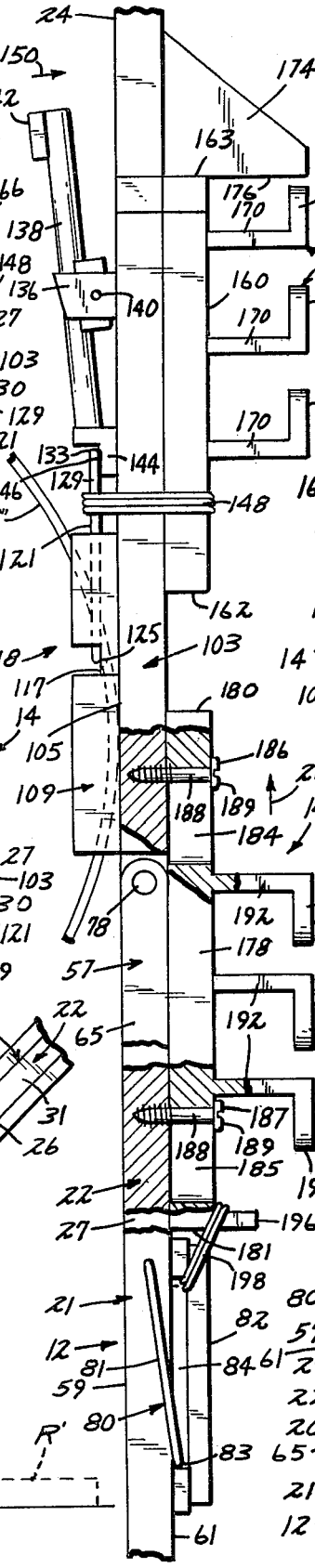
FIG. 9
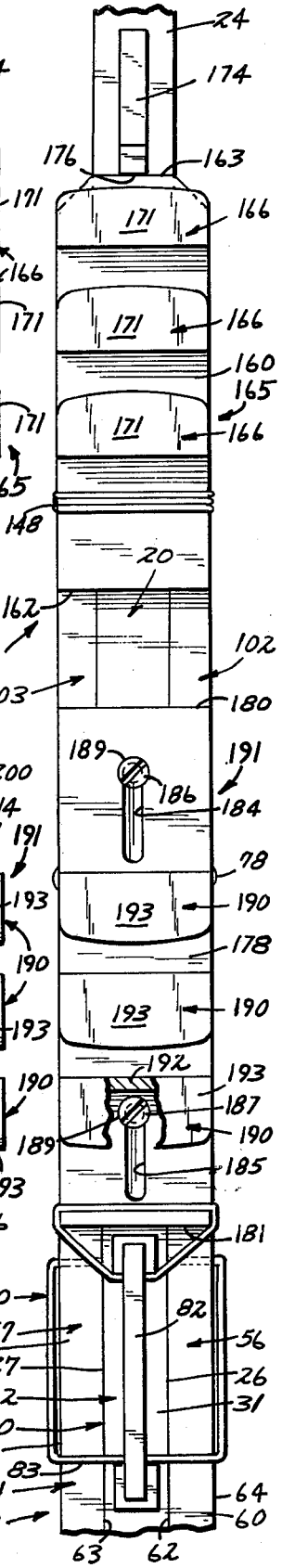
FIG. 12
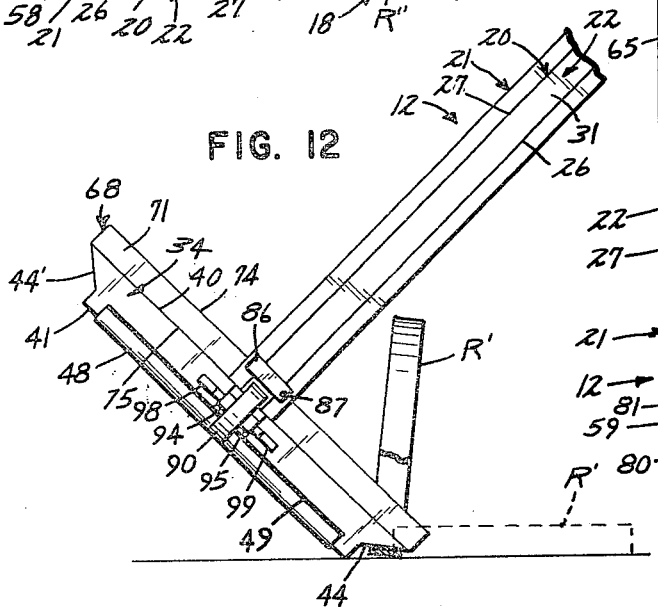

RING TOY

FIELD OF THE INVENTION

My invention relates to toys. In particular, my invention relates to a novel ring impelling toy which includes novel devices for launching rings and for storing rings when not in use.

BACKGROUND OF THE INVENTION

It is known in the art to provide generally T-shaped implements for advancing rolling objects such as rings across the ground. One problem with this type of ring impelling toy is that it can be very heavy and difficult to maneuver when made large enough to be held without the user bending over. A desirable feature with this type of toy is to provide an easy and convenient method for storing the rings when not in use. Another desirable feature is to provide a ring impelling surface which is substantially frictionless for better impelling characteristics and in order to prevent excessive wear and tear on the toy. Yet another desirable feature is to make the ring impelling toy adaptable for use in a number of different types of games. A further desirable feature is to provide the ring impelling toy with an inexpensive and easily constructed ring launching device for initiating rolling motion of the ring. It is also desirable to configure the ring impelling toy so that it can aid in picking up rings which lie flat on the ground.

PRIOR ART

It is known in the art to provide a T-shaped implement with a device for launching the rolling object to initiate rotational movement thereof. One such implement is disclosed in the patent to E. M. Murray, U.S. Pat. No. 1,243,334, issued Oct. 17, 1917. The Murray patent discloses a generally T-shaped structure which is provided with upstanding flanges 6 spaced apart to define a trackway 7 along which hoop 13 can roll after being released by latch 15. Latch 15 is pivotally mounted on a pin 16 and is biased by a spring 18, one end of which is fastened to lug 19 carried by shank 1. The hoop 13 is released or secured by the latch by pushing on or letting go of knob 17 at one end of the latch. The Murray device also includes guides 20 which are turned to provide flanges 21 to prevent the guides from slipping off the periphery of the hoop while it is being pushed along.

Another such device is disclosed in the patent to J. D. Mishler, U.S. Pat. No. 3,413,755, issued Dec. 3, 1968. The Mishler patent discloses an implement propelling device having a generally T-shaped structure with an elongated slot 15 for impelling rolling member 12 which is provided with a ring or rib 35 engaging slot 15.

SUMMARY OF THE INVENTION

I have invented a new and useful toy for impelling a rolling ring across the ground, which is adaptable for use in a number of different types of games.

A toy according to my invention includes a generally T-shaped first member having an elongated first main portion provided with a handle at one end and first cross piece mounted on and extending transversely across the other end. The toy further includes a generally T-shaped second member having an elongated second main portion and a second cross piece mounted on and extending transversely across one end of the second main portion. The other end of the second main portion is pivotally connected to the first main portion for pivotal movement of the second cross piece toward and away from the first cross piece so that the toy can be self-standing when the second member is moved away from the first member. The toy also includes a wheel rotatably mounted on the first member so that the toy can be pushed across the floor or ground to impel a rolling ring when the first and second members are retained together in an integral fashion.

My toy further includes a ring launching device for initiating rotational movement of the ring. The ring launching device includes a base member having a launching surface and a ring retention member mounted on the base member which can be releasably positioned to retain the ring on the launching surface. The ring is launched by suitably including the toy and withdrawing the ring retention member to release the ring, which then rolls to the ground.

My toy is further provided with a ring holder for storing a ring or a plurality of rings. The ring holder includes a first ring receiving member fixedly mounted on the toy, to engage a first portion of the ring, and a second ring receiving member spaced from the first ring receiving member to engage a second portion of the ring, and mounted on the toy for reciprocation away from the first ring receiving member, to hold the ring, and towards the first ring receiving member to receive and release the ring. The second ring receiving member is normally urged away from the first ring receiving member so that the ring or rings cannot accidentally fall out during storage.

BRIEF DESCRIPTION OF THE DRAWING

FIG. 7 is a fragmentary front view to a larger scale and partly in section showing a first launching device according to my invention;

FIG. 8 is a fragmentary side view, partly in section, of a launching device and a ring holding device according to my invention;

FIG. 9 is a fragmentary rear view showing a ring holding device according to my invention;

FIG. 10 is a sectional view taken along line 10—10 of FIG. 7;

FIG. 11 is a sectional view taken along line 11—11 of FIG. 7;

FIG. 12 is a fragmentary rear view of a toy according to my invention being used to pick up a ring;

DESCRIPTION OF THE PREFERRED EMBODIMENTS

Figure 1:
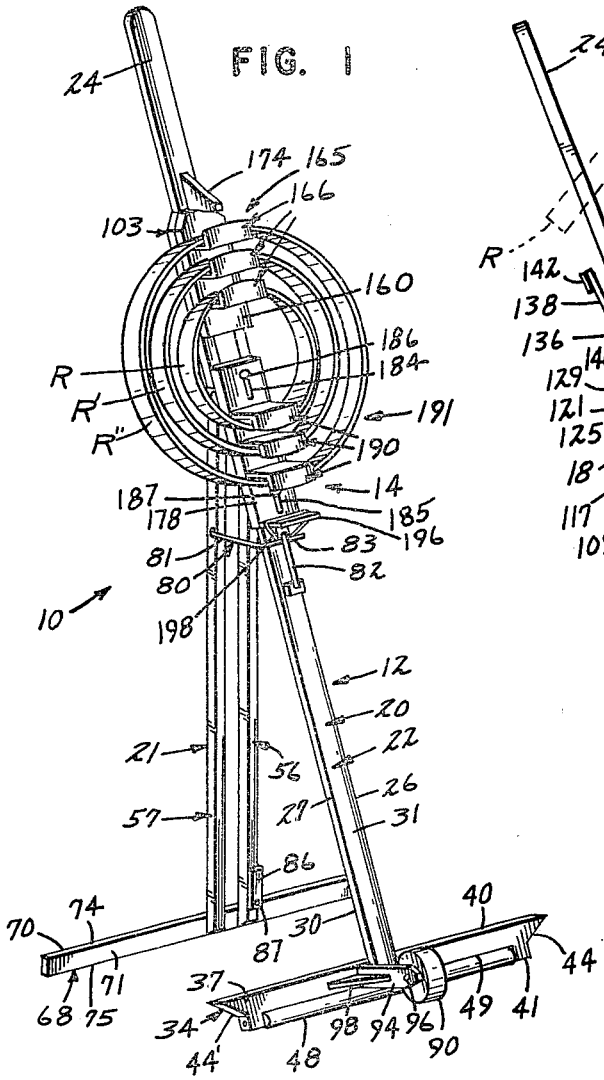
FIG. 1 shows a toy according to my invention in perspective with a plurality of rings stored on it.
Figure 2:
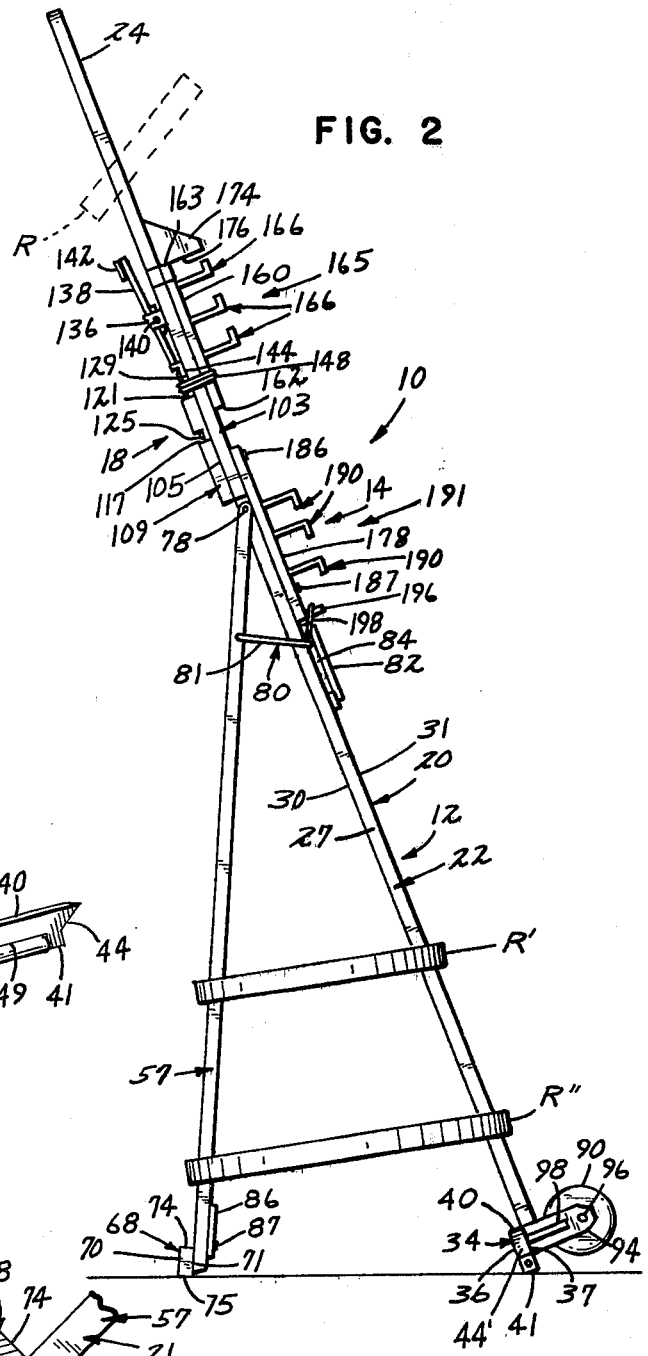
FIG. 2 is an enlarged side elevational view of a toy according to my invention being used as a ring toss game.

Referring now to the drawing, FIG. 1 shows a ring impelling toy generally designated at 10, made out of suitable material, such as wood, plastic or metal, for use with a plurality of rings, e.g., a small diameter ring R, an intermediate diameter ring R' and a large diameter ring R''. As also shown in FIG. 2, toy 10 generally comprises a base member 12, a ring holding device 14 and a ring launching device 18.

Figure 4:
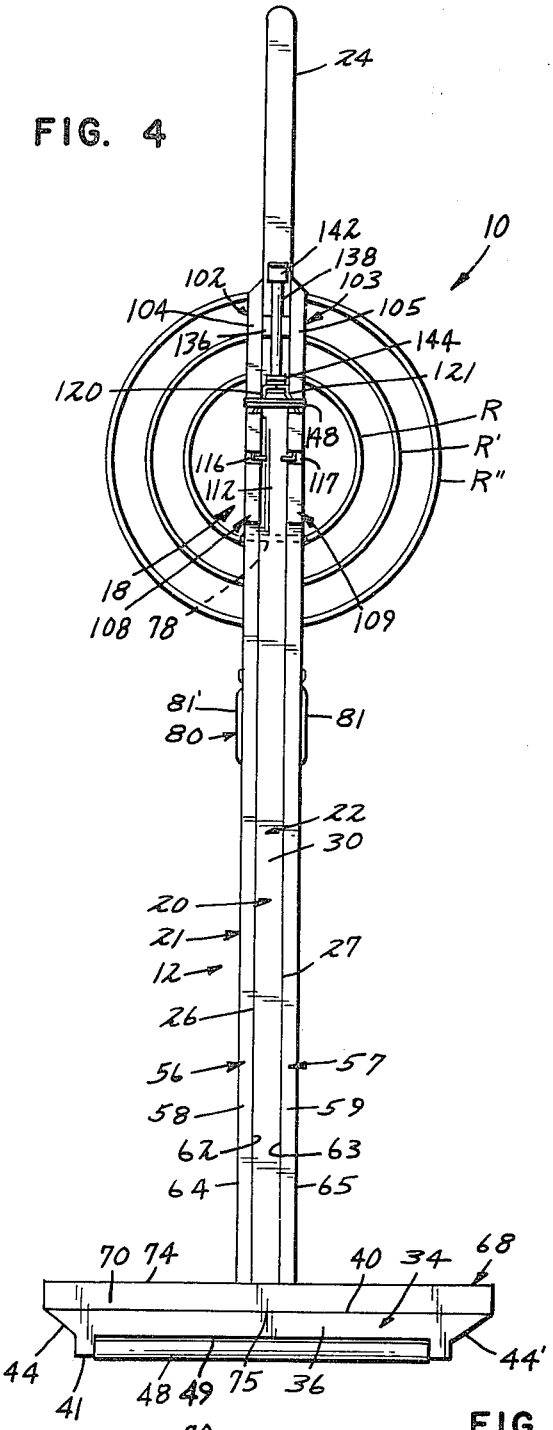
FIG. 4 is a front elevational view of a toy according to my invention.
Figure 5:
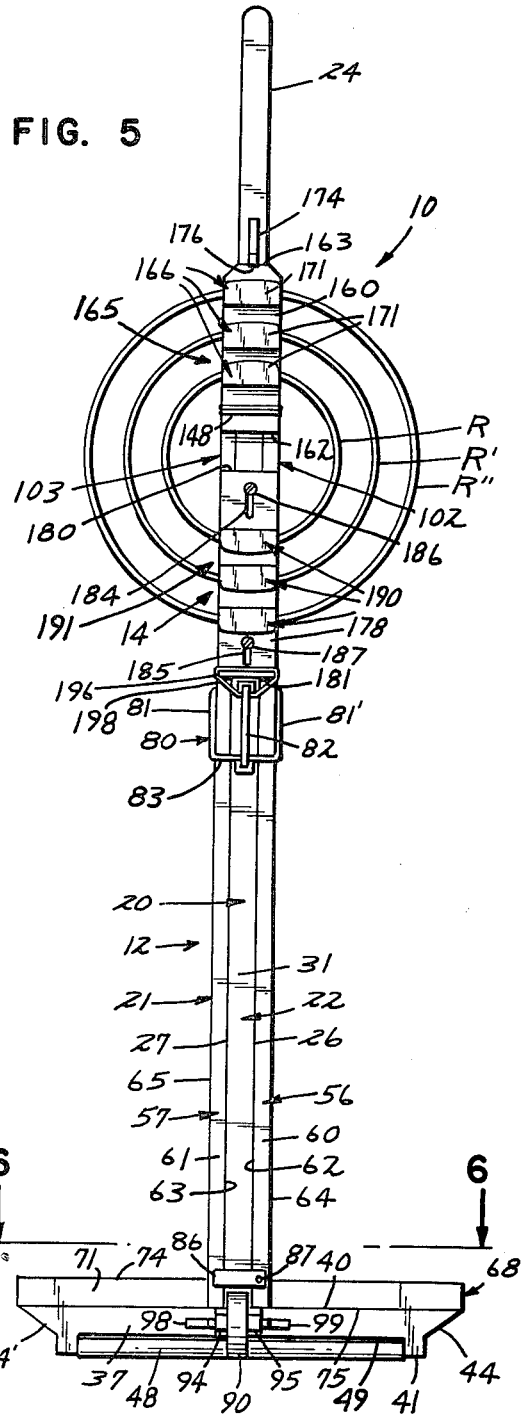
FIG. 5 is a rear elevational view of a toy according to my invention.

Referring now to FIGS. 4 and 5, base member 12 generally comprises a larger generally T-shaped first member 20 and a smaller generally T-shaped second member 21. Member 20 includes an elongated first main portion in the form of center piece 22 having a handle 24 at a first end, and having parallel side faces 26 and 27 and front and back generally planar surfaces 30 and 31. Member 20 further includes a first cross piece 34 perpendicularly mounted on the front surface of center piece 22 at the second end thereof. Cross piece 34 includes front and back generally planar surfaces 36 and 37, generally parallel top and bottom faces 40 and 41 and a pair of opposite ends having ring pickup notches 44 and 44' formed therein. A cylindrical member in the form of rod or roller 48 is rotatably mounted within a recess 49 in the bottom face of cross piece 34.

Second member 21 includes a second main portion in the form of a pair of elongated side pieces 56 and 57 which are parallel and spaced by the width of center piece 22 of first member 20. Side piece 56 and 57 have front generally planar surfaces 58 and 59, back generally planar surfaces 60 and 61, and generally parallel inner surfaces 62 and 63 and outer surfaces 64 and 65, respectively. Second member 21 further includes a second cross piece 68 mounted on the front surface of first ends to side pieces 56 and 57, and having ends extending outwardly beyond outer surfaces 64 and 65. Cross piece 68 has generally planar front and back surfaces 70 and 71 and generally parallel top and bottom surfaces 74 and 75.

The second ends of side pieces 56 and 57 are pivotally connected to center piece 22, between the handle end and the end on which the first cross piece 34 is mounted, by suitable means in the form of a dowel or pin indicated by numeral 78, for pivotal movement of the second cross piece towards and away from the first cross piece. Preferably, the second member 21 is pivotally connected to the first member 20 so that the bottom surface of second cross piece 68 abuts the top surface of first cross piece 34 and so that the second and first cross pieces are generally co-planar, and the front surfaces of the side pieces 56 and 57 and center piece 22 are also co-planar, when the back surface 71 of second cross piece 68 is in planar contact with the front surface 31 of center piece 22.

As shown in FIGS. 2 and 5, toy 10 further includes a device for limiting the pivotal movement of second member 21 with respect to first member 20. The movement limiting device comprises a generally U-shaped member 80 preferably made of wire, having a pair of generally parallel spaced arms 81 and 81' provided with ends which are bent inwardly and pivotally secured in the side edges of center piece 22 below pivot point 78. The limiting device further comprises a guide member 82 which is secured to the back surface of center piece 22 and which is configured to define therewith a slot 84 within which a transversely extending bottom portion 83 of U-shaped member 80 slides along the back surface of center piece 22. When second member 21 is pivoted away from the first member 20, the bottom portion 83 of the U-shaped member 80 slides within the slot until it reaches one end thereof, thus limiting further movement of the second member 21 away from the first member 20. The toy may now be stably supported on cross pieces 34 and 68, and thus is self-standing.

Figure 6:
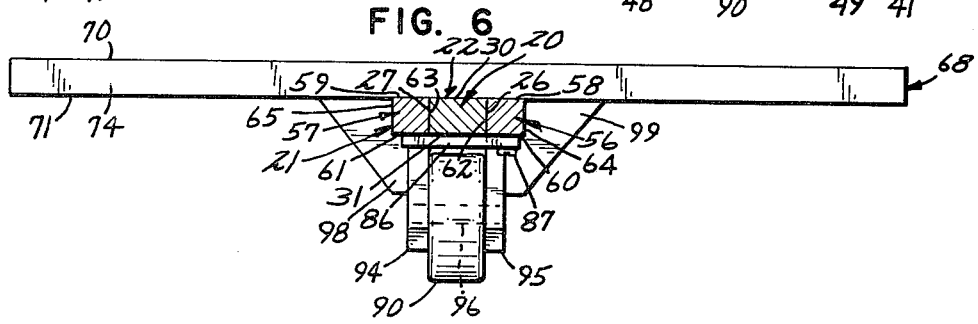
FIG. 6 is an enlarged sectional view taken along line 6—6 of FIG. 5.

As shown in FIGS. 5 and 6, toy 10 is also provided with a device in the form of a latch 86 for releasably holding second member 21 against first member 20. The latch is pivotally mounted on the back surface of side piece 60 by suitable means in the form of a screw 87 so that when latch 86 is pivoted across the back surfaces of center piece 22 and the other side piece 61, it secures first member 20 to second member 21 in an integral fashion.

As also shown in FIGS. 5 and 6, a wheel 90 is also provided which is positioned below latch 86. A pair of parallel spaced wheel support members 94 and 95 are connected to and extend generally perpendicularly and outwardly from the back surface of the first cross piece 34. Suitable means 96 is provided to pivotally mount wheel 90 between wheel support members 94 and 95. A pair of generally triangular braces 98 and 99 are also provided which are connected to and extend outwardly from the back surface of the first cross piece 34 and are further connected to the wheel support members 94 and 95.

Turning now to launching device 18, base member 12 is also provided with a pair of opposite flange pieces 102 and 103 which are secured to the center piece 22 slightly above pivot point 78. As shown in FIG. 4, when second member 21 is retained against first member 20, the front surfaces of the side pieces 56 and 57 and center piece 22 form a generally planar elongated launching surface for launching device 18, having a longitudinal axis along the length thereof. As shown particularly in FIGS. 7 and 8, device 18 includes a pair of spaced generally parallel longitudinal ring guide members 108 and 109 which are mounted on the flange pieces 102 and 103, mutually spaced by the width of rings to be launched, which extend generally parallel to the axis of the launching surface, so as to define therewith a trackway 112 through which the rings can roll. Ring guide members 108 and 109 have recesses 116 and 117, and bore holes 118 and 119 extend longitudinally from the recesses 116 and 117 to first ends of the guide members 108 and 109 for rotatably mounting ring retention means in the form of a pair of elongated members 120 and 121 preferably formed from wire. Members 120 and 121 have first ends 124 and 125 bent inwardly towards trackway 112 at recesses 116 and 117. Further portions 128 and 129 of the members 120 and 121 extend beyond the ends of ring guide members 108 and 109 as shown particularly in FIG. 7. Portions 128 and 129 are angled inwardly towards the axis of the launching surface, then parallel to the axis of the launching surface, and then are bent inwardly at ends 132 and 133 to extend parallel to ends 124 and 125. A post 136, which is spaced away from ends 132 and 133 of members 120 and 121, is mounted on the launching surface. A lever 138 is pivotally mounted on the post at fulcrum point 140 by a suitable pin. One end of the lever 138 has a thumb pad 142 mounted thereon while the other end has mounted thereon a member 144 having a notch 146 formed therein. Member 144 is positioned beneath ends 132 and 133 of members 120 and 121. Resilient means 148, such as one or more rubber bands, encircles base member 12 and extending portions 128 and 129 of members 120 and 121, so that bent ends 132 and 133 are biased towards the launching surface and into notch 146, member 120 and 121 being rotatable in bore holes 118 and 119 to permit this.

In order to use launching device 18, the thumb pad 142 is first depressed as indicated by arrow 150 so that ends 132 and 133 are rotated outwardly away from the launching surface, as shown by the dotted lines in FIG. 10. Ends 124 and 125 also rotate outwardly away from the launching surface as indicated by the dotted lines in FIG. 11. A ring is then inserted beneath ends 124 and 125. Thumb pad 142 is then released so that ends 132 and 133 can be returned by resilient means 148 down toward the launching surface. Ends 124 and 125 also rotate inwardly so as to retain the ring against the launching surface. When it is desired to launch the ring, the toy is suitably positioned with pieces 22, 56 and 57 inclined at a desired angle, and thumb pad 142 is again depressed so that bent ends 124 and 125 move out of the way and release the ring, which then rolls along trackway 112 and then downwardly along the launching surface.

As shown in FIGS. 8 and 9, ring holding device 14 includes a support member 160 fixedly mounted to the back of base member 12 by suitable means, such as cement. Support member 160 has a first end 162 and a second end 163. A first ring receiving member 165 including a first plurality of hooks 166 is mounted on support member 160. Each of the hooks is generally L-shaped and has a first leg 170 connected to and extending generally perpendicularly from support member 160, and a second leg 171 extending generally perpendicularly from first leg 170. As shown particularly in FIG. 9, the second legs 171 of the hooks 166 are aligned along a generally longitudinal axis and extend towards the second end 163 of support member 160. Device 14 further includes a generally triangularly shaped ring deflector 174 which is mounted on and extends outwardly from handle 24. Ring deflector 174 has a ring deflecting surface generally designated by numeral 176 which opposes or faces the second leg 171 of the hook closest to the rear end of support member 160.

Device 14 further includes a second support member 178 spaced from the first support member and having a first end 180 and a second end 181. A pair of elongated slots 184 and 185 are formed in the second support member. Suitable means 186 and 187 are provided, which have shank portions 188 secured to base member 12 and extending through the slots and heads 189 which are greater in size than the width of the slots so that the second support member 178 is slidably retained against base member 12. The slots 184 and 185 are aligned along a longitudinal axis so that the second support member 178 is mounted for linear reciprocation toward and away from the first support member 160.

Device 14 further includes a second ring receiving member 191 including a second plurality of hooks 190. Hooks 190 are also generally L-shaped each has a first leg 192 mounted on and extending generally perpendicularly and outwardly from the second support member 178, and a second leg 193 extending generally perpendicularly from the first leg 192. The second legs 193 of the second plurality of hooks 190 are aligned along a generally longitudinal axis in a direction opposite to that of the second legs 171 of the first plurality of hooks 166.

A member 196 which projects outwardly from the support member 178 at the second end thereof is also provided. An elastic member in the form of rubber band or bands 198 encircles the projecting member 196, as well as one end of guide member 82, so that the second support member 178 is urged away from the first support member 160.

As shown particularly in FIG. 1, the rings are retained in a concentric fashion by device 14. The first plurality of hooks 166 receive first portions of the rings while the second plurality of hooks 190 receive second, diametrically opposite portion, of the rings. Normally, rubber band 198 urges the second support member 178 away from the first support member 160 so that the rings are engaged by the hooks 166 and 190, to prevent the rings from accidentally falling out. When it is desired to remove a ring, the second support member 170 is moved toward the first support member 160, e.g., by pulling on one of the rings, as indicated by arrow 200 in FIG. 8, so that the ring is released. The ring deflector 174 serves to prevent the outermost ring from accidentally slipping out when stored.

Attention is directed to FIGS. 13–17, showing an embodiment of the invention which includes an improved launching device 218 as a replacement for device 18 described above.

Device 218 comprises a launching platform 220 from one face 221 of which they project a pair of ring guides 222, and from the other face 223 of which there project a pair of platform guides 224. Guides 222 are spaced by a distance $D_1$ equal to the width of a ring and are unitary, guides 224 are spaced by a distance $D_2$ equal to the combined widths of members 56, 20 and 57, and are made up of first generally triangular portions 225 and second generally triangular portions 226. A pair of pivot pins 227 project outwardly from portions 225 into spaced arms 230 of a clamping member 231 having thumb screws 232 for engaging side pieces 56 and 57. By this arrangement platform 220 may be slidingly positioned along said pieces 56 and 57, and be afforded pivotal movement with respect thereto about pins 227 which is limited at one extreme by engagement of surface 223 with center piece 222 and side pieces 56 and 57, and at the other extreme by a pair of tilt stop members 223 which bridge the gap between portions 225 and 226 and project inward to engage surfaces 58 and 59 of side pieces 56 and 57.

Portions 225 are provided with brackets 234, and portions 226 are provided with brackets 235 aligned therewith. Pivot pins 236 pass through brackets 234 and 235 and through a pair of levers 237 which are thus enabled to pivot in the gaps between portions 225 and 226: platform 220 is slotted as shown at 240, 240 to pass levers 237.

Figure 15:
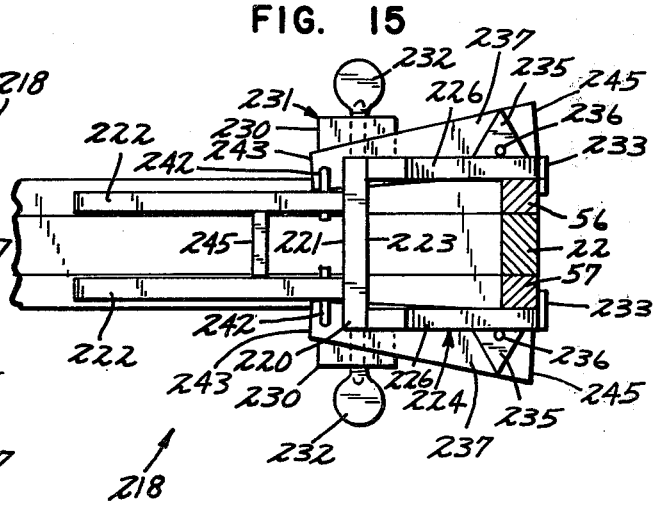
FIG. 15 is a view of the structure of FIG. 13 generally in section taken along the line 15—15—of FIG. 13, the ring being omitted.
Figure 17:
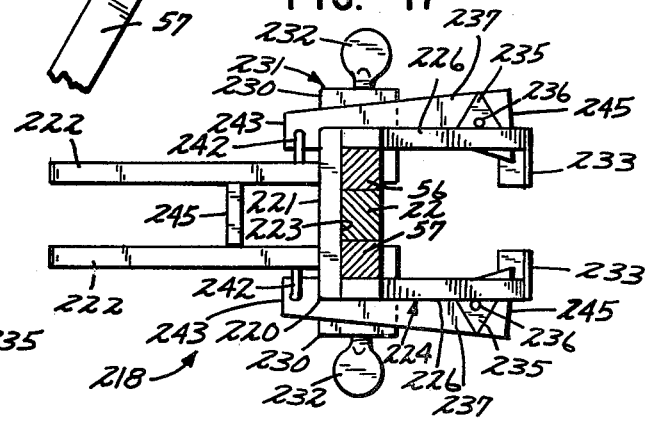
Figure 19:
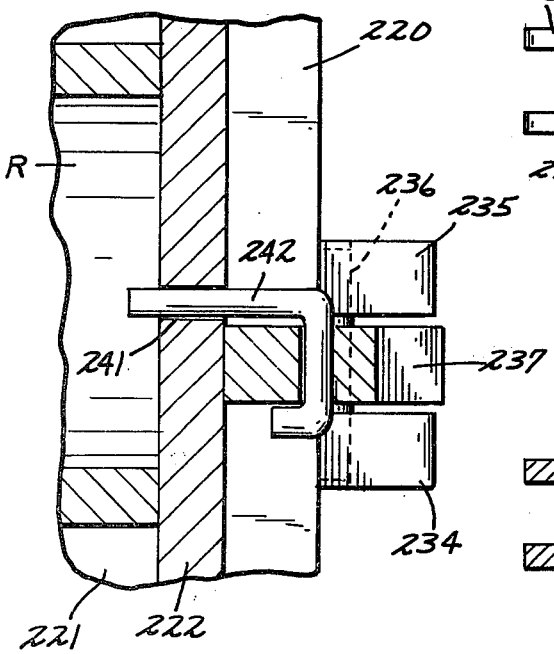
FIG. 19 is a fragmentary view, in section taken along the line 19—19 of FIG. 13, to a larger scale.
Figure 18:
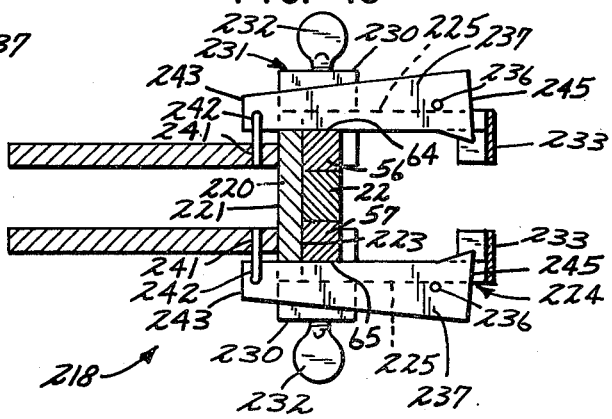
FIG. 18 is a fragmentary view in section taken along the line 18—18 of FIG. 16.

As shown in FIG. 19, ring guides 222 are provided with apertures 241 in line with levers 237 and spaced from surface 221 a platform 220 by more than the thickness of a ring, and pin members 242 are pivotally mounted at first ends 243 of levers 237, to be received and moved linearly in apertures 241. The levers are so shaped, as best shown in FIG. 18, that when platform 223 is pivoted outwardly, as shown by arrow 244 in FIG. 13, second ends 245 of levers 237 engage surfaces 64 and 65 of side pieces 56 and 57, pivoting the first ends 243 of the levers inwardly into engagement with the outer surfaces of guides 222, and sliding pin members 242 to projecting inwardly into the space between the ring guides, as shown in FIG. 15. When platform 220 is pivoted inwardly as shown by arrow 246, ends 243 of levers 237 engage surfaces 64 and 65 and are thus moved away from guides 220, retracting pin members 242 into spaces 241 in guides 222, as shown in FIG. 17. A handle 247 is secured to guides 222 to facilitate manipulation of platform 220 between its two positions.

Figure 13:
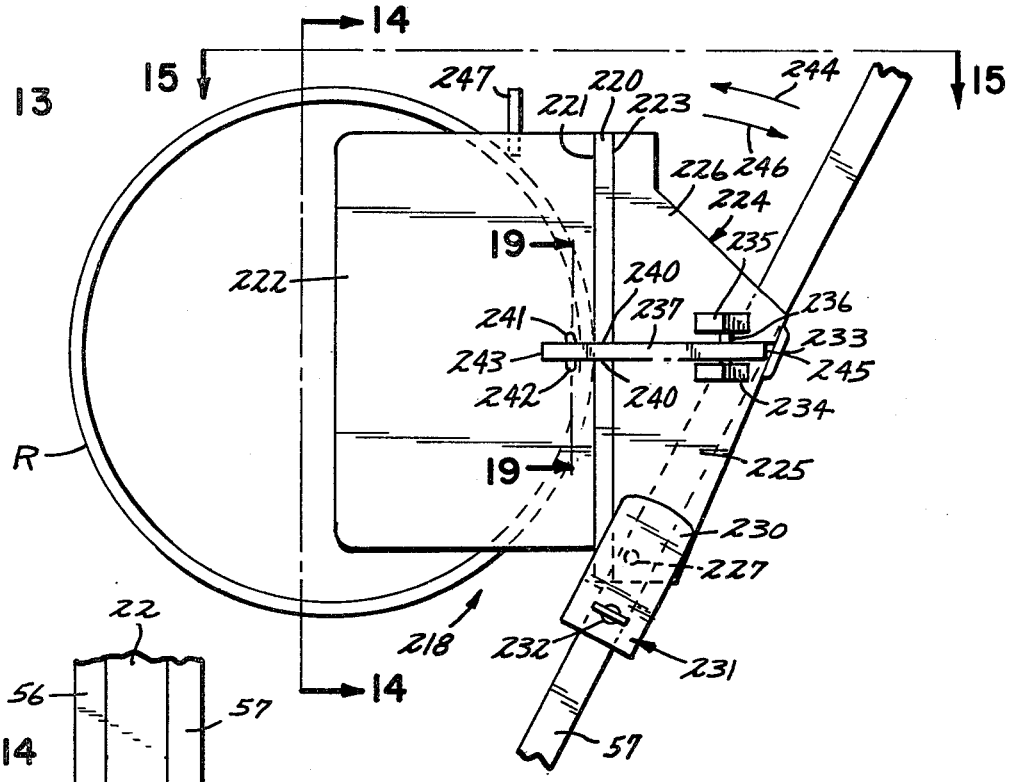
FIG. 13 is a fragmentary elevational view of my toy showing a second launching device in a ring-retaining condition.
Figure 14:
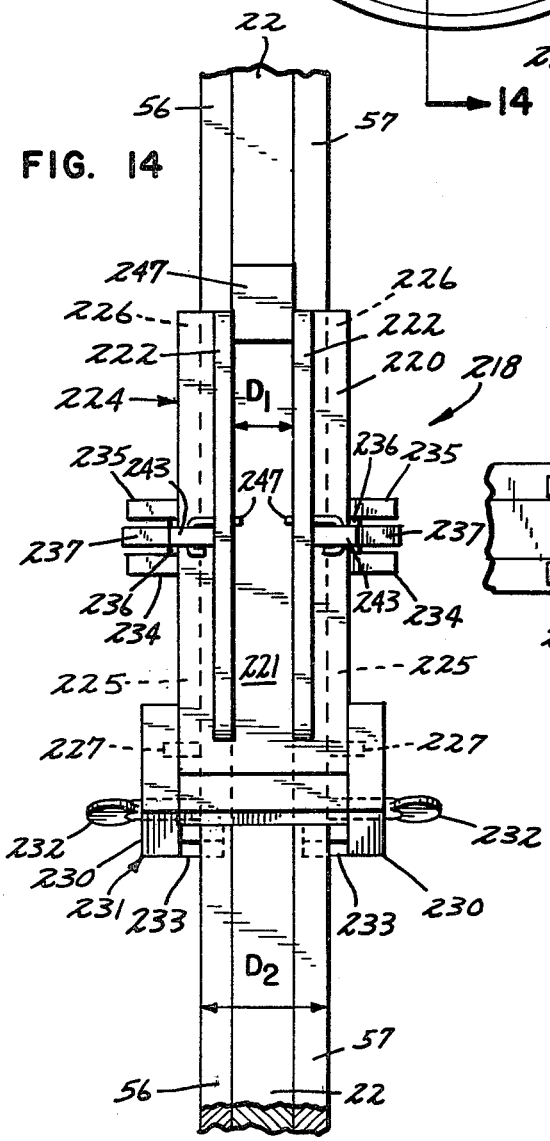
FIG. 14 is a view of the structure of FIG. 13 seen from the line 14—14 of FIG. 13, the ring being omitted.
Figure 16:
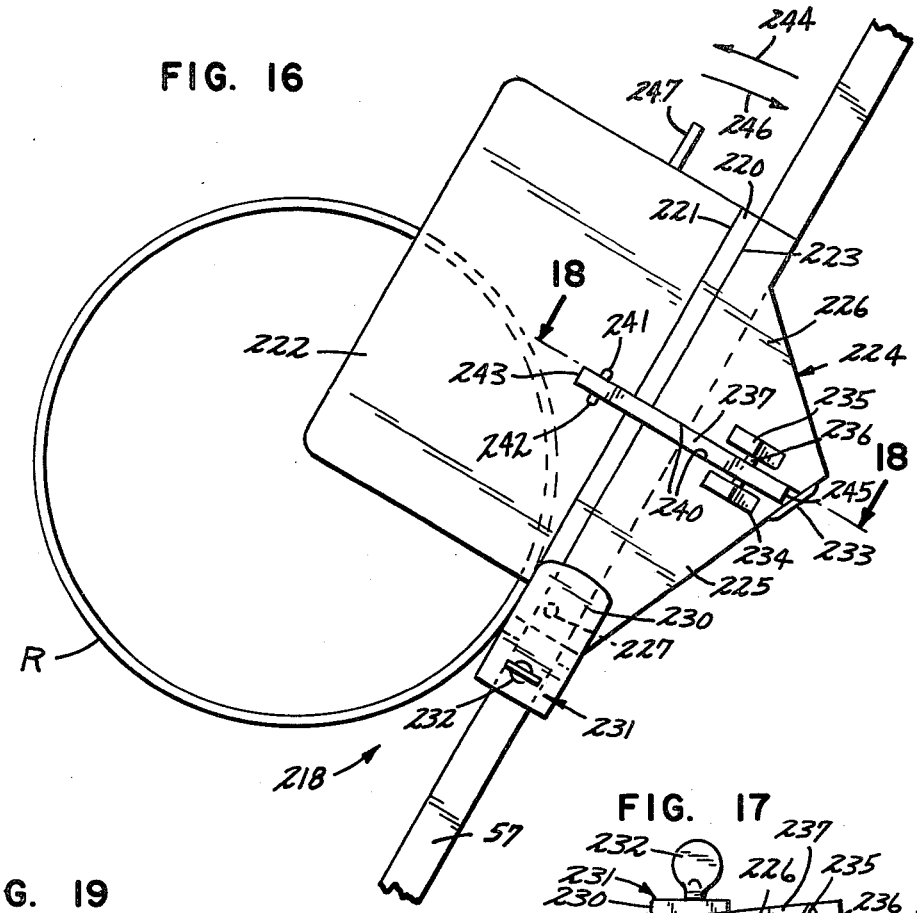
FIGS. 16 and 17 are like FIGS. 13 and 15 but show the launching device in its ring-releasing condition.

It is not necessary to continually hold device 218 in its ring-retaining position by manual pressure against handle 247. Launching device 218 is so constructed that its own weight is effective to cause its pivotal movement about the axis of pins 227, depending on the angulation of second member 21 with respect to the vertical. When member 21 is steeper than a predetermined angle, device 218 pivots about the axis in the direction of arrow 224, as shown in FIG. 13, particularly if the weight of a ring R is included. When member 21 is less steep than the predetermined angle, device 218 pivots about the axis in the direction of arrow 246, as shown in FIG. 16. For a ring of any particular size and weight, the angle of member 21 at which the pivotal movement of device 218 takes place is always substantially the same.

To load the launching device, platform 220 is positioned in the direction of arrow 246, against member 21, by maipulation of handle 24 or handle 247, withdrawing pins 242. A ring R to be launched is placed between guides 222 and against surface 221, touching the latter near levers 237: for at least one diameter of ring this positioning is facilitated by handle 247. Platform 220 and the ring are now pivoted in the direction of arrow 244, by raising member 21 to a sufficiently steep angle, causing pins 242 to project so that they can engage the inner periphery of the ring, which is thus held stably between guides 222. When it is desired to release the ring, the toy is positioned so that the launching track comprised of members 22, 56 and 57 is located as desired in direction, and handle 24 is operated to decrease the steepness of member 21, so as to enable platform 200 to pivot in the direction of arrow 246. Pins 242 release ring R, which rolls down platform 220 and then down the launching track. Since its position at release is stabilized by guides 222, the movement of the ring is initiated smoothly and the ring rolls down the launching track without incident.

It will be evident that the speed at which ring R rolls as it reaches the ground may be varied by releasing thumb screws 232 and sliding launcher 218 along members 56, 57 to a position nearer to or further from the ground.

OPERATION

As shown particularly in FIG. 1, toy 10 is self-standing when the second member 21 is pivoted far enough away from the first member 20. Furthermore, as shown particularly in FIG. 2, the toy can thus be utilized as a ring toss game wherein the handle 24 serves as the target for the ring. Scoring can be based on the size of the ring, e.g., one point for the largest ring, two points for the intermediate size ring and three points for the smallest ring. The distance from the target can be determined by the skill and age of the players.

Figure 3:
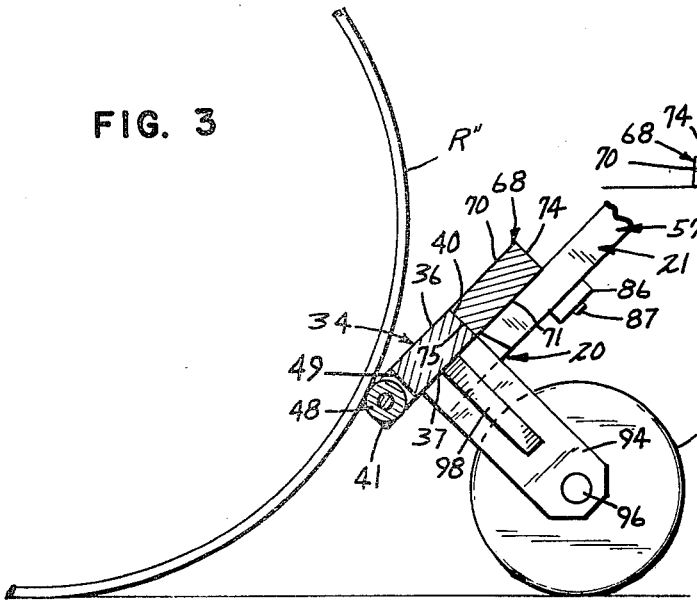
FIG. 3 is an enlarged fragmentary view of a toy according to my invention being used to impel a rolling ring.

As shown in FIG. 3, the toy can be pushed along on the rotating wheel 90 so as to propel a rolling ring, such as R″, when first member 20 and second member 21 are folded and then held together by latch 86. The cylindrical member 48 serves to minimize the amount of friction between the rolling ring and the toy and thus prevent excessive wear and tear to the first cross piece 34. The ring can be rolled along the ground by the toy either freely or in organized games. One such game is similar to croquet wherein the rings are guided through a series of hoops placed in the ground. Another game is similar to hockey wherein a ring is passed between the players using the toy in an attempt to roll it through a goal while being opposed by another team. A third game is to set up an obstacle course to challenge a player's skill in guiding the ring. The different sized rings give different speeds, e.g., the larger the ring, the faster the speed, at which the game are played so as to equalize the different abilities of the players involved.

As shown particularly in FIG. 12, the toy can be used to pick up a ring lying flat on the ground. One of the pickup notches 44 or 44′ formed in the first cross piece 34 is placed over one edge of the ring shown by the dotted lines. The toy is then pressed down so as to cause the opposite side of the ring to rise up and over the ends of cross pieces 34 and 68 as shown by the solid black lines.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A ring toy, comprising:

a generally T-shaped first member having an elongated generally linear center piece, said center piece having a front generally planar surface a back generally planar surface, opposite generally parallel side surfaces, a first, handle end, a second end spaced from said first end, and a first cross piece perpendicularly connected to said front surface of said center piece at said second end of said center piece and extending transversely beyond said side edges, said first cross piece having a front surface, a back surface, a top surface, a bottom surface and a pair of opposite spaced ends, each of said ends of said first cross piece having notches formed therein;

a generally T-shaped second member having a pair of parallel elongated side pieces spaced the width of said center piece, each of said side pieces having a front surface, a back surface, opposite generally parallel spaced inner and outer side surfaces and first and second spaced ends, and a second cross piece connected transversely to said front surface at said second ends of said side pieces and extending beyond said outer surfaces, said second cross piece having a front surface, a back surface, a top surface, and a bottom surface; said side pieces being pivotally connected at said first ends to said center piece between said first and second ends thereof, for pivotal movement of said second cross piece toward and away from said first cross piece so that said bottom surface of said second cross piece abuts said top surface of said first cross piece and so that said second and first cross pieces are generally coplanar and said side pieces and center piece are generally coplanar when said back surface of said second cross piece is in planar contact with said front surface of said center piece;

a wheel;

a pair of spaced wheel support members connected to and extending from said back surface of said first cross piece to rotatably mount said wheel;

a latch pivotally connected to said back surface of one of said side pieces for pivotal movement across said back surfaces of said center pieces and the other of said side pieces to releasably secure said first member to said second member;

a generally U-shaped member including a pair of arms having first bent ends, and a bottom portion transversely interconnecting said arms, each of said first bent ends being pivotally secured to said outer edge of one of said side pieces;

a guide member secured to said back surface of said center piece and configured to define therewith a slot within which said bottom portion of said U-shaped member slides to limit said pivotal movement of said second member with respect to said first member; and a cylindrical roller rotatably mounted within said bottom edge of said first cross piece.

2. A ring launching device for initiating rolling movement of a ring, comprising:

a base member having a launching surface, said launching surface having a longitudinal axis;

ring retention means;

means for mounting said retention means on said base member to engage the inner periphery of a ring to be launched;

means for resiliently holding said retention means in engagement with the inner periphery of a ring to be launched to retain the ring between said retention means and said launching surface; and means for moving said retention member out of said engagement to release the ring, wherein said retention means further comprises a second end spaced from said first end and extending inwardly toward said axis, and wherein said holding means comprises an elastic member encircling said base member and said retention member to bias said second ends of said member toward said launching surface, and wherein said moving means comprises a lever having one end positioned beneath said second end away from said launching surface and outwardly from said axis, and means for pivotally mounting said lever on said base member.

3. A ring launching device for initiating rolling movement of a ring, comprising:

a base member having a launching surface, said launching surface having a longitudinal axis;

ring retention means;

means for mounting said retention means on said base member to engage the inner periphery of a ring to be launched;

means for resiliently holding said retention means in engagement with the inner periphery of a ring to be launched to retain the ring between said retention means and said launching surface; and means for moving said retention member out of said engagement to release the ring, wherein the means mounting said retention means comprises a pair of mutually spaced longitudinal ring guide members mounted on said base member and directed away from and generally parallel to said axis, each of said guide members having a recess formed therein, said elongated member being rotatably mounted within one of said guide members and having a second end portion extending inwardly toward said axis, said first end of each of said side elongated members being positioned within said recesses formed in said guide members.

4. A ring launching device for initiating rolling motion of a ring comprising:

a base member including an elongated generally planar launching surface having a longitudinal axis;

a pair of mutually spaced longitudinal ring guide members mounted on said launching surface and directed away from and generally parallel to said axis to define a trackway therebetween, each of said guide members further including a recess and a bore extending from said recess to an end of said guide member;

a pair of elongated members having first and second ends, one of said elongated members being rotatably mounted within said bore of each of said guide members, a first end of each of said elongated members having a portion extending generally toward said axis, and a second end of each of said members having a portion angled inwardly toward said axis, and a further portion extending from said angled portion generally parallel to said axis, and a final portion extending generally toward, said axis, said first ends being positioned within the recesses of said guide members;

a post mounted on said launching surface and spaced from said second bent ends of said pieces;

a lever pivotally mounted on said post, one end of said lever having a notch formed therein positioned beneath said first portions of said ends of said members; and a resilient means encircling said base member and said further portions of said second ends of said pieces to bias said second bent ends into said notch of said lever.

5. In a ring toy, in combination:

a launching track;

a launching device having a first, ring holding position and a second, ring releasing position; and means pivotally securing said device to said track so that said device is gravitationally actuated between said positions as the angle of said track with respect to the vertical varies above and below a predetermined value.

6. In a ring toy, in combination:

a launching track;

a launching device having a first, ring holding position and a second, ring releasing position; and means pivotally securing said device to said track so that said device is gravitationally actuated from said first position to said second position as the angle of said track with respect to the vertical decreases beyond a predetermined value.

* * * * *

UNITED STATES PATENT AND TRADEMARK OFFICE

CERTIFICATE OF CORRECTION

PATENT NO. : 4,227,341

DATED : October 14, 1980

INVENTOR(S) : William A. Kaul, Jr.

It is certified that error appears in the above-identified patent and that said Letters Patent are hereby corrected as shown below:

Column 3, line 40, "piece", second occurrence should be --pieces--;

Column 7, line 34, "maipulation" should be --manipulation--;

Column 8, line 20, "game" should be --games--.

Signed and Sealed this

*Third* Day of *February 1981*

[SEAL]

*Attest:*

RENE D. TEGTMEYER

*Attesting Officer*

*Acting Commissioner of Patents and Trademarks*